US006745735B2

(12) United States Patent
Smith

(10) Patent No.: US 6,745,735 B2
(45) Date of Patent: Jun. 8, 2004

(54) AIR VENTING MECHANISM FOR VARIABLE CAMSHAFT TIMING DEVICES

(75) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/376,899

(22) Filed: Feb. 28, 2003

(65) Prior Publication Data

US 2003/0196625 A1 Oct. 23, 2003

Related U.S. Application Data

(60) Provisional application No. 60/374,165, filed on Apr. 19, 2002.

(51) Int. Cl.[7] ..... F01L 1/34

(52) U.S. Cl. ..... 123/90.17; 123/90.15; 123/90.31; 464/160

(58) Field of Search ..... 123/90.15, 90.16, 123/90.17, 90.18, 90.27, 90.31; 464/1, 2, 160; 92/78, 79

(56) References Cited

U.S. PATENT DOCUMENTS

| | | | | | |
|---|---|---|---|---|---|
| 2,861,557 | A | * | 11/1958 | Stolte | 123/90.15 |
| 5,002,023 | A | | 3/1991 | Butterfield et al. | 123/90.15 |
| 5,107,804 | A | | 4/1992 | Becker et al. | 123/90.17 |
| 5,172,659 | A | | 12/1992 | Butterfield et al. | 123/90.17 |
| 5,184,578 | A | | 2/1993 | Quinn, Jr. et al. | 123/90.17 |
| 5,289,805 | A | | 3/1994 | Quinn, Jr. et al. | 123/90.17 |
| 5,361,735 | A | | 11/1994 | Butterfield et al. | 123/90.17 |
| 5,497,738 | A | | 3/1996 | Siemon et al. | 123/90.17 |
| 5,657,725 | A | | 8/1997 | Butterfield et al. | 123/90.17 |
| 5,694,894 | A | * | 12/1997 | Allen | 123/90.16 |
| 6,247,434 | B1 | | 6/2001 | Simpson et al. | 123/90.17 |
| 6,250,265 | B1 | | 6/2001 | Simpson | 123/90.17 |
| 6,263,846 | B1 | | 7/2001 | Simpson et al. | 123/90.17 |
| 6,311,655 | B1 | | 11/2001 | Simpson et al. | 123/90.17 |
| 6,363,896 | B1 | * | 4/2002 | Speier | 123/90.17 |
| 6,374,787 | B2 | | 4/2002 | Simpson et al. | 123/90.17 |
| 6,460,496 | B2 | | 10/2002 | Fukuhara et al. | 123/90.17 |
| 6,477,999 | B1 | | 11/2002 | Markley | 123/90.17 |
| 6,647,936 | B2 | * | 11/2003 | Lewis | 123/90.17 |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A device includes: a locking member substantially disposed within a closure in the housing, the locking member locking the housing and the rotor free from relative rotation and independent of fluid flow; and at least one vent passage disposed between either the first or the second chamber and the closure in the housing; thereby air within the chamber is purged and noise stopped.

6 Claims, 3 Drawing Sheets

AIR VENTING MECHANISM FOR VARIABLE CAMSHAFT TIMING DEVICES

REFERENCE TO RELATED APPLICATIONS

This application claims an invention which was disclosed in Provisional Application Number 60/374,165, filed Apr. 19, 2002, entitled "Air Venting Mechanism for Variable Camshaft Timing Devices". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of Variable Camshaft Timing (VCT). More particularly, the invention pertains to air venting mechanism for variable camshaft timing devices.

2. Description of Related Art

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes A camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is described. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

In at least some of the about listed variable camshaft timing mechanisms, in order for a variable camshaft timing mechanism to operate with maximum efficiency it is typically desirable to limit the leakage of fluids from the device such as a phaser. In order to limit the leakage, elements such as sealing elements are used. The introduction of the elements or methods employed to limit the leakage of fluid also make it difficult to purge the air from the VCT device. Air inside the device is known to cause the VCT device to oscillate and cause impact at mechanical limits, which generates undesirable noise in the valve train.

Therefore, it is desirous to introduce a suitable venting means such as a vent passage into the VCT hydraulic chamber at predetermined time periods. The venting means would be connected to a lock pin mechanism as the venting outlet for allowing air within the chamber to escape in such a way that the vent would be open when the lock pin is engaged and closed when the lock pin is disengaged.

SUMMARY OF THE INVENTION

A vent passage is provided which leads into the VCT hydraulic chamber. This vent passage would be connected to the lock pin mechanism such that the vent would be open when the lock pin is engaged and closed when the lock pin is disengaged.

An open vent is provided which would allow air to escape from the VCT high-pressure chamber with the lock pin preventing the VCT from oscillating.

A closed vent is provided when the lock pin releases is in a releasing state, wherein the vent is closed, thereby preventing excess leakage from the VCT hydraulic chamber and thus limit the oscillation of the VCT caused by leakage.

Suitable dimensions or sizes of the vent passage are provided such that air would be allowed to escape the VCT working chamber before building sufficient oil pressure within the VCT device to release the lock pin. Thereby VCT operate quietly is assured in that the VCT device would not release the lock pin until sufficient air was purged. The result is that VCT device operates more quietly.

A phaser is provided such that air inside the phaser are released before mechanical movements between a rotor and a housing are allowed.

Accordingly, a VCT device including a housing and a rotor disposed to rotate relative to each other is provided. The housing has at least one cavity disposed to be divided by a vane rigidly attached to the rotor. The vane divides the cavity into a first chamber and a second chamber. The device further includes passages connecting the first and the second chamber facilitating the oscillation of the vane within the cavity by transferring fluid between the first chamber and the second chamber. The device includes: a locking member substantially disposed within a closure in the housing, the locking member locking the housing and the rotor free from relative rotation and independent of fluid flow; and at least one vent passage disposed between either the first or the second chamber and the closure in the housing; thereby air within the chamber is purged and noise stopped.

Accordingly, a method is provided in a VCT device including a housing and a rotor disposed to rotate relative to each other. The housing has at least one cavity disposed to be divided by a vane rigidly attached to the rotor. The vane divides the cavity into a first chamber and a second chamber. The device further includes passages connecting the first and the second chamber facilitating the oscillation of the vane within the cavity by transferring fluid between the first chamber and the second chamber. The method includes the steps of: providing a locking member substantially disposed within a closure in the housing, the locking member locking the housing and the rotor free from relative rotation and independent of fluid flow; and providing at least one vent passage disposed between either the first or the second chamber and the closure in the housing; thereby air within the chamber is purged and noise stopped.

DETAILED DESCRIPTION OF THE INVENTION

Figure 1:
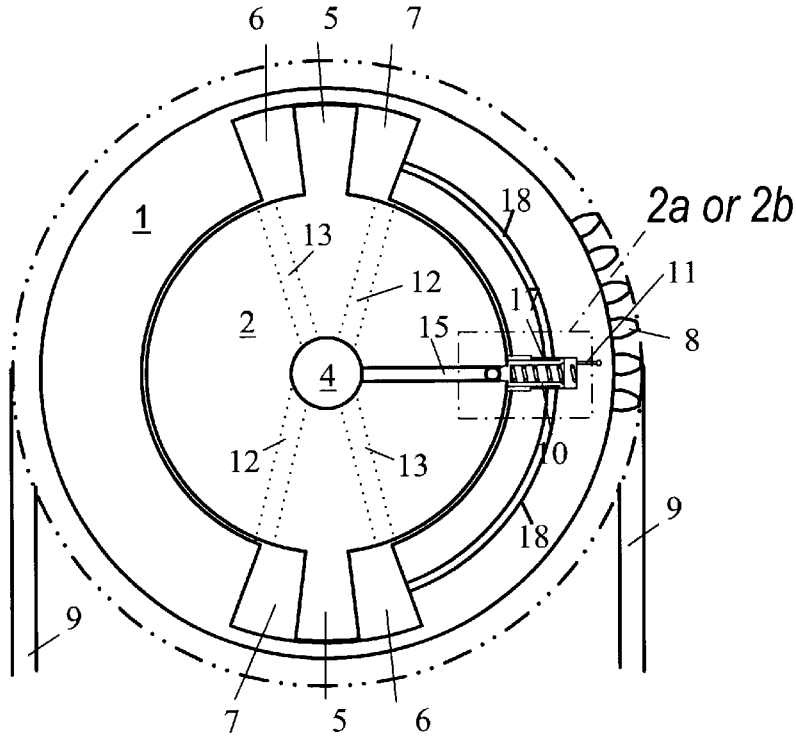
FIG. 1 shows a schematic of a phaser of the present invention.

Referring to FIG. 1, a vane-type VCT phaser comprises a housing (1), the outside of which has sprocket teeth (8) which mesh with and are driven by timing chain (9). Inside the housing (1), a cavity including fluid chambers (6) and (7) is defined. Coaxially within the housing (1), free to rotate relative to the housing, is a rotor (2) with vanes (5) which fit between the chambers (6) and (7), and a central control valve (4) which routes pressurized fluid via passages (12) and (13) to chambers (6) and (7), respectively. Pressurized fluid introduced by valve (4) into passages (12) will push vanes (5) counterclockwise relative to the housing (1), forcing fluid out of chambers (6) into passages (13) and into valve (4). A fluid passage (15) supplies fluid such as engine oil and suitably pressurizes a lock pin (10) slidably fitted within a casing (17). It will be recognized by one skilled in the art that this description is common to vane phasers in general, and the specific arrangement of vanes, chambers, passages and valves shown in FIG. 1 may be varied within the teachings of the invention. For example, the number of vanes and their location can be changed, some phasers have only a single vane, others as many as a dozen, and the vanes might be located on the housing and reciprocate within chambers on the rotor. The housing might be driven by a chain or belt or gears, and the sprocket teeth might be gear teeth or a toothed pulley for a belt.

Figure 2A:
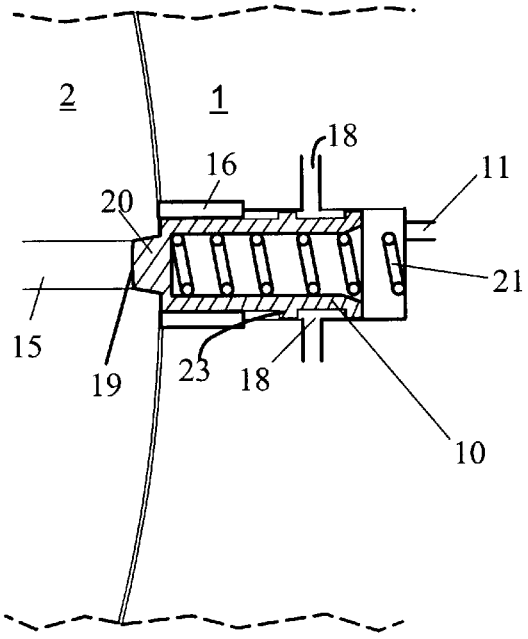
FIG. 2*a* shows a first aspect of the present invention.

Referring to FIG. 1 and the detail of FIG. 2*a*, in the phaser of the invention, lock pin (10) slides along the walls of casing (17) which may be a bore in the housing (1), and is engaged by a spring (21) for allowing an inner end (20) of pin (10) to fit into a recess (19) formed in the rotor (2) to lock the rotor (2) and housing (1) into a fixed rotational position. Vent (11) allows any fluid which might leak past passage (15) before recess (19) is closed by an inner end (20) of lock pin (10) to be discharged.

Figure 2B:
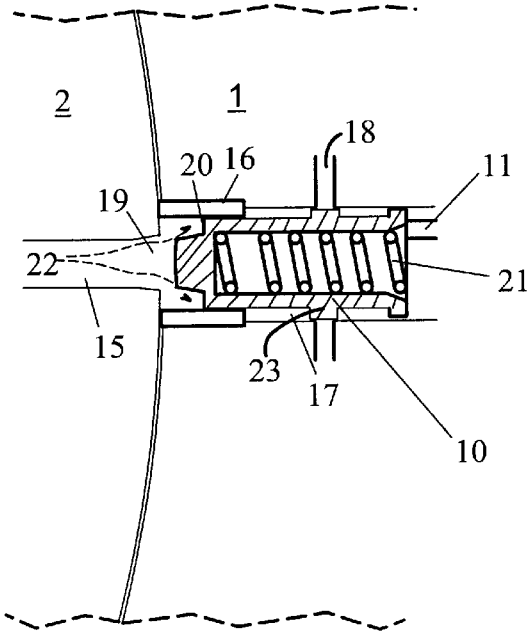
FIG. 2*b* shows a second aspect of the present invention.

The fluid passage (15) feeds pressurized fluid from the engine oil supply (not shown) into the recess (19). The dimensions of relevant parts such as passage (15) and lock pin (10) are chosen such that at engine start-up, the piston cannot push the lock pin (10) back against the force of the spring (21) until the supply oil pressure has risen to a level which is sufficient that fluid in passages (12) or (13) can fully fill chambers (6) and (7) and purge any air which might have been introduced due to leakage while the engine was shut down. In order to facilitate an improved means of purging the air inside the chambers (6) and (7), a vent passage (18) is provided which interposed between one of the chambers (6) and (7), and lock pin mechanism that has a suitable air outlet. For example, chamber (7) is connected via vent passage (18) to the lock pin mechanism as shown in FIG. 2*a*, wherein vent (11) serves the dual purpose of both purging the air inside the chamber (7) and allowing any fluid which might leak past passage (15) to be discharged. In this case, lock pin (10) may have structure similar to a spool valve in that at a first position, air within chamber (7) is purged. Whereas, on the other hand, when the lock pin (10) is at a second position as shown in FIG. 2*b*, vent passage (18) is structurally stopped from acting as a conduit for communicating between one chamber and the lock pin mechanism. The stoppage can be achieved in various ways. Depending on the shape of the lock pin, a flange can be formed around the same if the pin is of annular shape. If the lock pin body has an elongated polygonal shape, any element extending from the lock pin body that is sufficient to block vent passage (18) thereby stopping fluid communication function of the same is contemplated by the present invention. The flange or the element is denoted by numeral (23).

The present invention will be better understood by the following description. When fluid pressure has risen to a predetermined pressure (22) (or higher), lock pin (10) is pushed back from recess (19), as shown in FIG. 2*b*. When the piston (10) is pushed out of the tapered recess (19), fluid can flow past the piston (10) and push against the larger area (20) of the lock pin (10). This larger area allows a lower pressure to hold the pin back than was required to move the piston away from the recess in the first instance. At this juncture, element (23) stops fluid communication via vent passage (18) between vent (11) and one of the chambers (6) and (7).

On the other hand, when pressure (22) is below the predetermined value, fluid communication via vent passage (18) between vent (11) and one of the chambers (6) and (7) resumes. For example, when the engine is shut down or the crank speed is below a predetermined limit, the pressure in passage (15) drops below the chosen pressure which will hold the pin (10) sufficiently against the force of the spring (21), and the lock pin (10) moves toward the rotor (2). When the pin (10) and recess (19) come into alignment, the pin (10) drops into the recess (19), and locks the rotor (2) and housing (1) once more.

Figure 3:
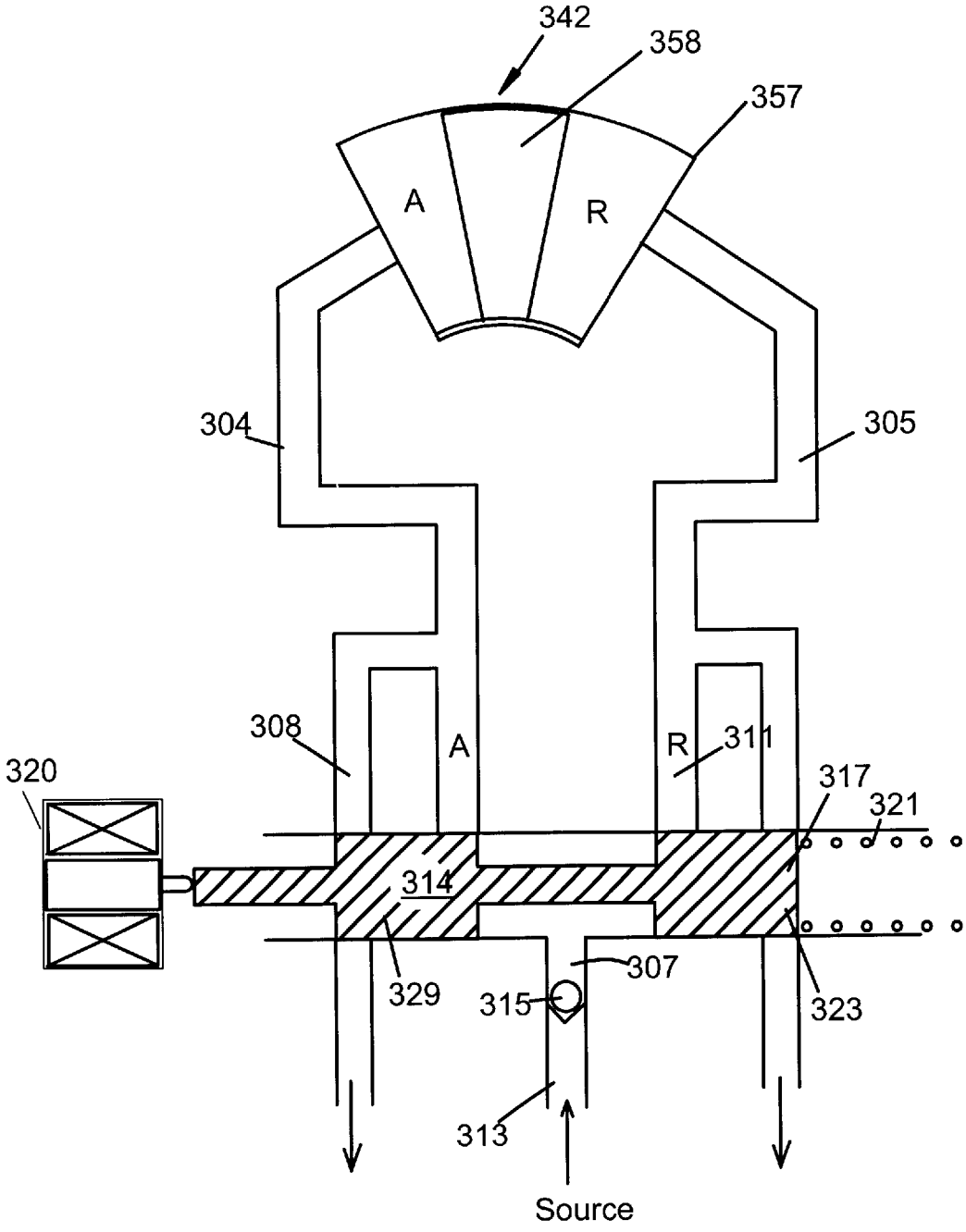
FIG. 3 shows, in part, the VCT system of the present invention.

FIG. 3 is a schematic depiction that shows, in part, the VCT system of the present invention. A null position is shown in FIG. 3. Solenoid (320) engages spool valve (314) by exerting a first force upon the same on a first end (329). The first force is met by a force of equal strength exerted by spring (321) upon a second end (317) of spool valve (314) thereby maintaining the null position. The spool valve (314) includes a first block (319) and a second block (323) each of which blocks fluid flow respectively.

The phaser (342) includes a vane (358), a housing (357) using the vane (358) to delimit an advance chamber A and a retard chamber R therein. Typically, the housing and the vane (358) are coupled to crank shaft (not shown) and cam shaft (also not shown) respectively. Vane (358) is permitted to move relative to the phaser housing by adjusting the fluid quantity of advance and retard chambers A and R. If it is desirous to move vane (358) toward the retard side, solenoid (320) pushes spool valve (314) further right from the original null position such that liquid in chamber A drains out along duct (304) through duct (308). The fluid further flows or is in fluid communication with an outside sink (not shown) by means of having block (329) sliding further right to allow said fluid communication to occur. Simultaneously, fluid from a source passes through duct (313) and is in one-way fluid communication with duct (307) by means of one-way valve (315), thereby supplying fluid to chamber R via duct (305). This can occur because block (323) are moved further right causing the above one-way fluid communication to occur. When the desired vane position is reached, the spool valve is commanded to move back left to its null position, thereby maintaining a new phase relationship of the crank and cam shaft.

Figure 4:
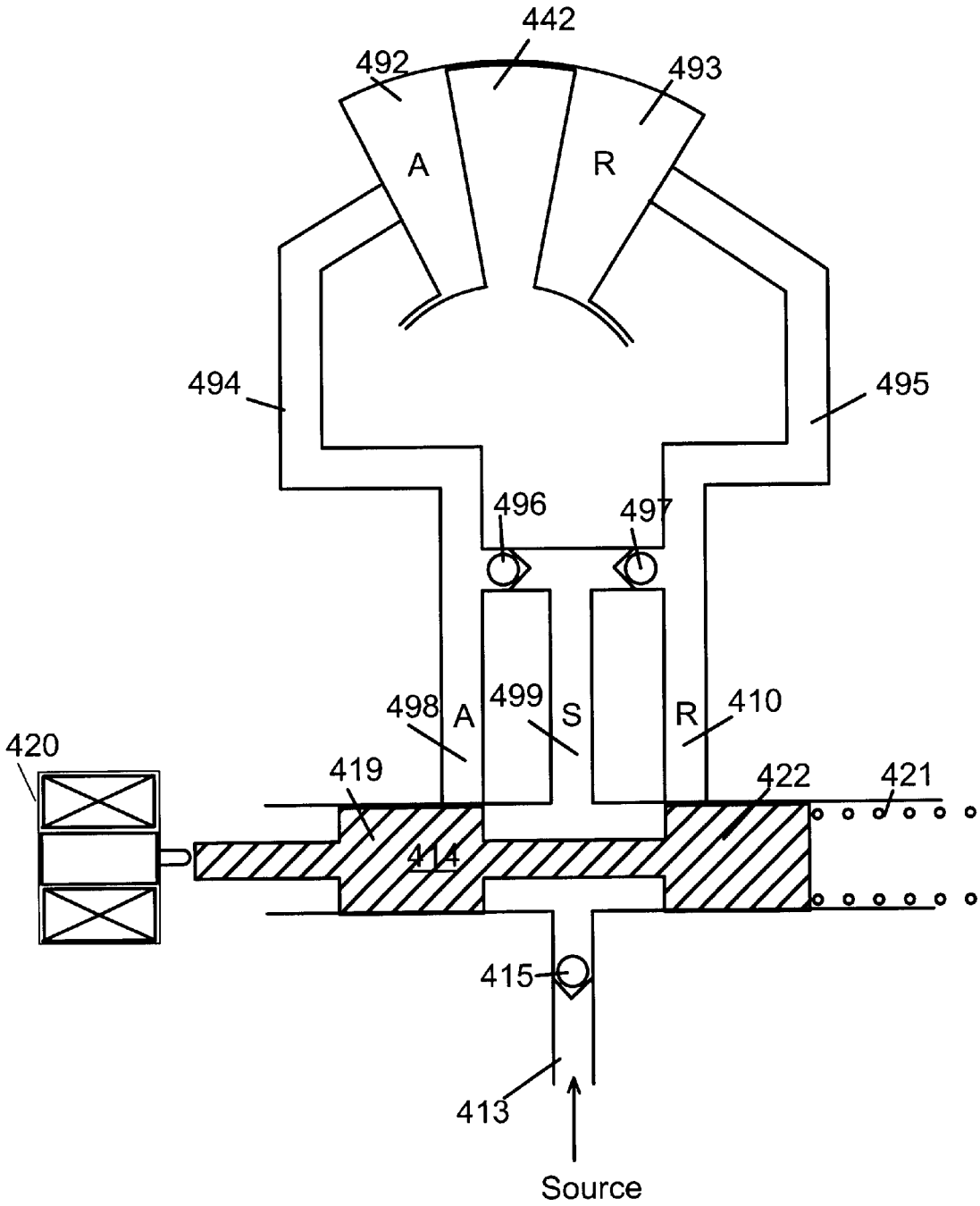
FIG. 4 shows a Cam Torque Actuated (CTA) VCT system applicable to the present invention.

Referring to FIG. 4, a Cam Torque Actuated (CTA) VCT system applicable to the present invention is shown. The CTA system uses torque reversals in camshaft caused by the forces of opening and closing engine valves to move vane (442). The control valve in a CTA system allows fluid flow from advance chamber (492) to retard chamber (493) or vice versa, allowing vane (442) to move, or stops fluid flow, locking vane (442) in position. CTA phaser may also have oil input (413) to make up for losses due to leakage, but does not use engine oil pressure to move phaser.

The detailed operation of CTA phaser system is as follows. FIG. 4 depicts a null position in that ideally no fluid flow occurs because the spool valve (414) stops fluid circulation at both advance end (498) and retard end (410). When cam angular relationship is required to be changed, vane (442) necessarily needs to move. Solenoid (420), which engages spool valve (414), is commanded to move spool (414) away from the null position thereby causing fluid within the CTA circulation to flow. It is pointed out that the CTA circulation ideally uses only local fluid without any fluid coming from source (413). However, during normal operation, some fluid leakage occurs and the fluid deficit needs to be replenished by the source (413) via a one way valve (415). The fluid in this case may be engine oil. The source (413) may be the oil pan.

There are two scenarios for the CTA phaser system. First, there is the Advance scenario, wherein an Advance chamber (492) needs to be filled with more fluid than in the null position. In other words, the size or volume of chamber (492) is increased. The advance scenario is accomplished by way of the following.

Solenoid (420), preferably of the pulse width modulation (PWM) type, pushes the spool valve (414) toward right such that the left portion (419) of the spool valve (414) still stops fluid flow at the advance end (498). But simultaneously the right portion (422) moved further right leaving retard portion (410) in fluid communication with duct (499). Because of the inherent torque reversals in camshaft, drained fluid from the retard chamber (493) feeds the same into advance chamber (492) via one-way valve (496) and duct (494).

Similarly, for the second scenario which is the retard scenario wherein a Retard chamber (493) needs to be filled with more fluid than in the null position. In other words, the size or volume of chamber (493) is increased. The retard scenario is accomplished by way of the following.

Solenoid (420), preferably of the pulse width modulation (PWM) type, reduces its engaging force with the spool valve (414) such that an elastic member (421) or forces spool (414) to move lest. The right portion (422) of the spool valve (414) stops fluid flow at the retard end (410). But simultaneously the left portion (419) moves further right leaving Advance portion (498) in fluid communication with duct (499). Because of the inherent torque reversals in camshaft, drained fluid from the Advance chamber (492) feeds the same into Retard chamber (493) via one-way valve (497) and duct (495).

As can be appreciated, with the CTA cam phaser, the inherent cam torque energy is used as the motive force to re-circulate oil between the chambers (492, 493) in the phaser. This varying cam torque arises from alternately compressing, then releasing, each valve spring, as the camshaft rotates. As can be appreciated, in order for a variable camshaft timing mechanism or device to operate with maximum efficiency, it is desirable to limit the leakage from the device. The same methods employed to limit the leakage of the oil also creates difficulties in purging the air from the VCT device. Air inside the device causes the VCT to oscillate and impact at its mechanical limits, which generates noise in the valve train.

It is contemplated that the present invention be applied to any hydraulically operated variable camshaft timing mechanism. The concept of the present invention is to introduce a vent passage into the VCT hydraulic chamber. This vent passage would be connected to the lock pin such that the vent would be open when the lock pin is engaged and closed when the lock pin is disengaged.

The open vent would allow air to escape from the VCT high-pressure chamber while the lock pin prevents the VCT from oscillating. When the lock pin is in a released state, it would close the vent and prevent excess leakage from the VCT hydraulic chamber and thus limit the oscillation of the VCT caused by leakage.

The vent passage could be sized such that air would be allowed to escape the VCT working chamber before building sufficient oil pressure in the VCT to release the lock pin. That would assure the VCT would not be released until sufficient air was purged to make the VCT operate quietly The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Camber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or-by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A VCT device including a housing and a rotor disposed to rotate relative to each other, the housing having at least one cavity disposed to be divided by a vane rigidly attached to the rotor, the vane dividing the cavity into a first chamber and a second chamber, the device further including passages connecting the first and the second chamber facilitating the oscillation of the vane within the cavity by transferring fluid between the first chamber and the second chamber, the device comprising:

a locking member substantially disposed within a closure in the housing, the locking member locking the housing and the rotor free from relative rotation and independent of fluid flow; and at least one vent passage disposed between either the first or the second chamber and the closure in the housing; thereby air within the chamber is purged and noise stopped.

2. The device of claim 1 further comprising a fluid passage supplying fluid for unlocking the locking member.

3. The device of claim 1, wherein the locking member is a lock pin having elements thereon disposed to stop fluid communication between either the first or the second chamber and the closure in the housing.

4. In a VCT device including a housing and a rotor disposed to rotate relative to each other, the housing having at least one cavity disposed to be divided by a vane rigidly attached to the rotor, the vane dividing the cavity into a first chamber and a second chamber, the device further including passages connecting the first and the second chamber facilitating the oscillation of the vane within the cavity by transferring fluid between the first chamber and the second chamber, a method comprising the steps of:

providing a locking member substantially disposed within a closure in the housing, the locking member locking the housing and the rotor free from relative rotation and independent of fluid flow; and providing at least one vent passage disposed between either the first or the second chamber and the closure in the housing; thereby air within the chamber is purged and noise stopped.

5. The method of claim 4 further comprising providing a fluid passage supplying fluid for unlocking the locking member.

6. The method of claim 4, wherein the locking member is a lock pin having elements thereon disposed to stop fluid communication between either the first or the second chamber and the closure in the housing.

* * * * *